US005212952A

United States Patent [19]

Yokoyama et al.

[11] Patent Number: 5,212,952

[45] Date of Patent: May 25, 1993

[54] COMPACT POWER SUPPLY AND LUBRICANT AFFORDING DEVICE THEREFOR

[75] Inventors: Yoshiharu Yokoyama; Shigeru Akiyama; Kazuhito Kitano, all of Iwata, Japan

[73] Assignee: Yamaha Hatsudoki Kabushiki Kaisha, Iwata, Japan

[21] Appl. No.: 827,535

[22] Filed: Jan. 29, 1992

Related U.S. Application Data

[63] Continuation of Ser. No. 692,775, Apr. 26, 1991, abandoned, which is a continuation of Ser. No. 377,480, Jul. 10, 1989, abandoned.

[30] Foreign Application Priority Data

Jul. 9, 1988 [JP] Japan ..... 63-171291

[51] Int. Cl.[5] ..... F02B 63/04

[52] U.S. Cl. ..... 60/721; 290/1 A; 290/46; 123/1 A; 184/6

[58] Field of Search ..... 60/721; 123/1 R, 1 A, 123/2, 196 R, 527; 290/1 A, 1 B, 46; 184/6

[56] References Cited

U.S. PATENT DOCUMENTS

| | | | |
|---|---|---|---|
| 1,522,612 | 1/1925 | Burchett | 290/1 A |
| 1,585,831 | 5/1926 | Bradford | 290/46 |
| 3,259,752 | 7/1966 | Honda | 290/1 B |
| 3,617,762 | 11/1971 | Price | 290/46 |
| 3,837,433 | 9/1974 | Combs, Jr. et al. . | |
| 4,122,353 | 10/1978 | Noguchi | 290/1 A |
| 4,503,812 | 3/1985 | Eberhardt | 123/527 X |
| 4,541,397 | 9/1985 | Young | 123/527 |
| 4,608,946 | 9/1986 | Tanaka | 290/1 A |
| 4,835,405 | 5/1989 | Clancey et al. | 290/1 A |

FOREIGN PATENT DOCUMENTS

| | | |
|---|---|---|
| 1175489 | 8/1964 | Fed. Rep. of Germany . |
| 3243784 | 5/1984 | Fed. Rep. of Germany . |
| 1280305 | 2/1961 | France . |
| 1508080 | 11/1967 | France . |
| 1545018 | 11/1967 | France . |
| 2384134 | 3/1977 | France . |
| 61-21554 | 6/1986 | Japan . |
| 2069063 | 8/1981 | United Kingdom . |

*Primary Examiner*—Allen M. Ostrager
*Attorney, Agent, or Firm*—Ernest A. Beutler

[57] ABSTRACT

A compact portable electrical generator powered by a gas fueled internal combustion engine. A combined starter and generator is coupled to the engine for starting of the engine and for generating electrical power when the engine is running. The engine includes a lubricating system including lubricant that is supplied from a separately insertable lubricant cartridge and which is pumped by a hose compressing type of pump so as to insure adequate delivery of small amounts of lubricant regardless of the orientation of the unit and also so as to insure that lubricant cannot leak from the system when the unit is not being operated.

16 Claims, 4 Drawing Sheets

COMPACT POWER SUPPLY AND LUBRICANT AFFORDING DEVICE THEREFOR

This is a continuation of U.S. patent application Ser. No. 692,775, filed Apr. 26, 1991, abandoned; which application is a continuation of application Ser. No. 377,480, filed Jul. 10, 1989, abandoned.

BACKGROUND OF THE INVENTION

This invention relates to a compact power supply and to an improved lubricant affording device therefor.

The use of portable generators for providing electrical power for a variety of purposes is well known. For the most part, these power supplies are relatively large and cumbersome. There is, however, a particular demand for a small, readily portable power supply of this type that will provide moderate electrical power outputs. Although a variety of arrangements have been provided for this purpose, for the most part, they are either cumbersome or inefficient.

It is, therefore, a principal object of this invention to provide an improved, compact electrical power supply that can be easily portable and which will operate with a high efficiency.

It has been found that a compact portable power supply may be provided by employing a small internal combustion engine that is powered by a pressurized gaseous fuel. In order to permit a compact assembly, the engine should be liquid cooled and should be readily started from a starter and also drive a generator to provide power outputs. Of course, the provision of such components can give rise to a rather bulky construction.

It is, therefore, a further object of this invention to provide a compact electrical power supply driven by a gas fueled internal combustion engine which is liquid cooled and nevertheless compact.

In connection with such compact power units, it is particularly advantageous to employ two-cycle internal combustion engines. The advantages of two-cycle engines and their simplicity and relatively high power outputs for a given displacement are well known. However, it is desirable to insure that the engine be adequate lubricated so as to insure long life. When the engine is fueled by a gaseous fuel, it is not possible to mix lubricant with the fuel as with conventional gasoline powered two-cycle engines.

Although separate lubricating systems have been proposed for two-cycle engines, these systems normally employ reciprocating piston type pumps that are driven in some manner from the engine. Although such pumps are adequate for larger displacement engines, for extremely small displacement engines relatively low amounts of lubricant are required. In addition, the portability of the unit as aforenoted means that it may be operated in any of a plurality of orientations. Conventional lubricating systems for engines are designed so as to be operated in only a certain specific orientation or minor variations from that orientation. With the conventional lubricating systems, the operation of the engine in a different orientation can significantly effect the amount of lubricant that is delivered to the engine.

It is, therefore, a further object of this invention to provide an improved lubricating system for a small gas powered engine.

It is a further object of this invention to provide an improved lubricant pump that is particularly adapted to supply small amounts of lubricant.

In addition to the aforenoted problems with conventional lubricating systems for engines, there is additionally the problem that when the engine is in a different orientation, the lubricant may drain from the lubricant tank by gravity.

It is, therefore, a further object of this invention to provide an improved lubricant pump for an engine wherein the pump acts as a shutoff valve by its inherent construction and operation so that fuel cannot inadvertently be discharged when the engine is not operating and regardless of the orientation of the unit.

SUMMARY OF THE INVENTION

A first feature of this invention is adapted to be embodied in a compact portable power supply that is comprised of an internal combustion engine and a liquid cooling system for the engine that comprises a cooling jacket for the engine, a radiator and means for circulating coolant between the cooling jacket and the radiator. A combined generator, starter is coupled to the engine for starting the engine and for generating electrical power when the engine is running. A battery is incorporated for operating the starter when starting and for being charged by the started when the engine is running. A source of pressurized gaseous fuel is also provided for supplying fuel to the engine for its running. All of the aforenoted components are contained within an outer housing having a carrying handle and an air inlet opening and an air outlet opening. The radiator is juxtaposed to one of the air openings for cooling by the air flowing through the outer housing from the air inlet to the air outlet.

Another feature of the invention is adapted to be embodied in a lubricant supply system for a small engine lubricating system. The lubricant supply system includes conduit means that extend from a lubricant supply to the engine lubricating system and which includes a flexible hose portion. Pumping means are provided for sequentually compressing a part of the flexible hose portion close to the lubricant supply and moving and subsequently compressing parts of the hose portion toward the engine lubricant supply for delivering lubricant thereto.

DETAILED DESCRIPTION OF THE PREFERRED EMBODIMENT

Figure 1:
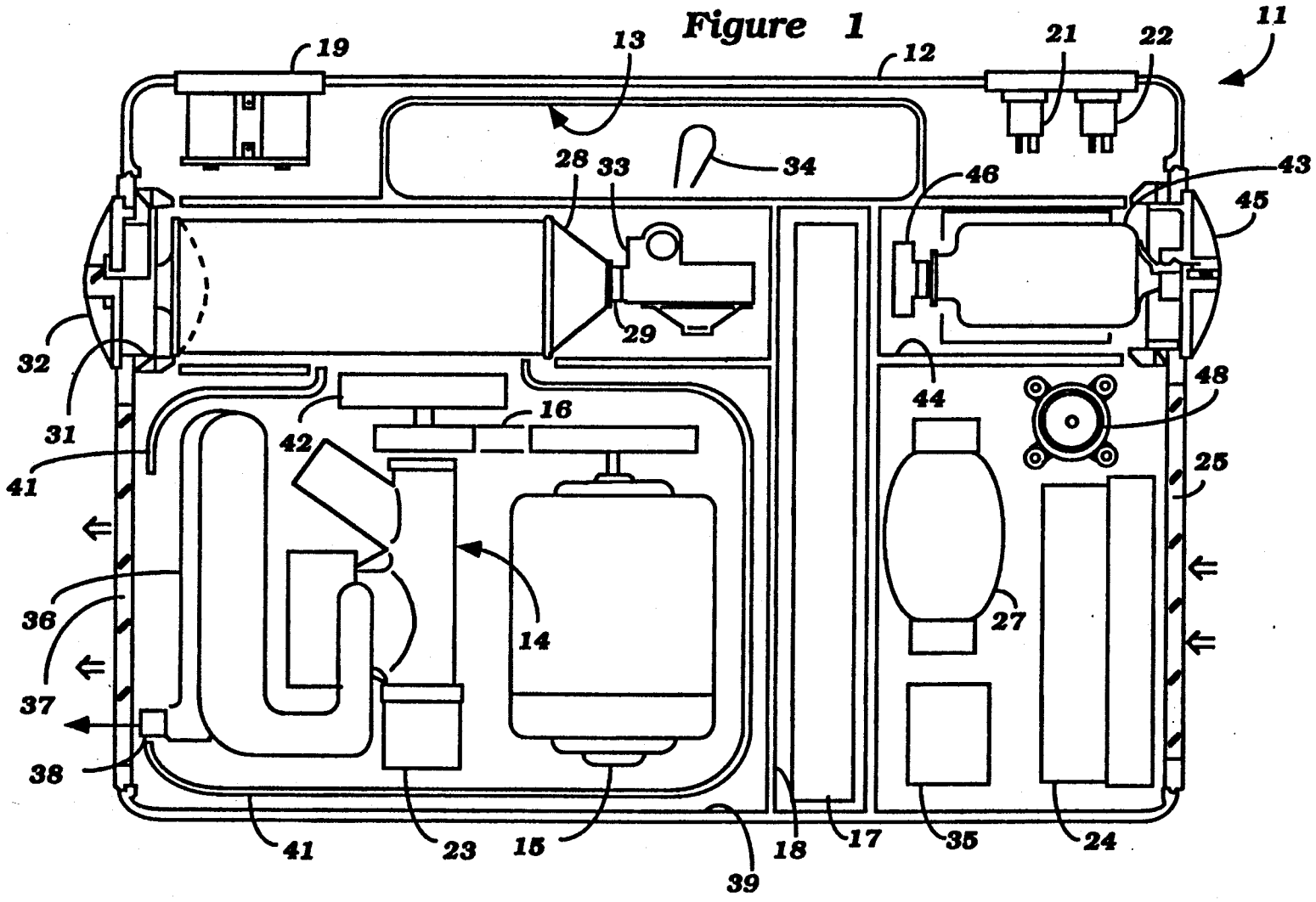
FIG. 1 is a cross-sectional view taken through a portable power supply constructed in accordance with an embodiment of the invention.
Figure 2:
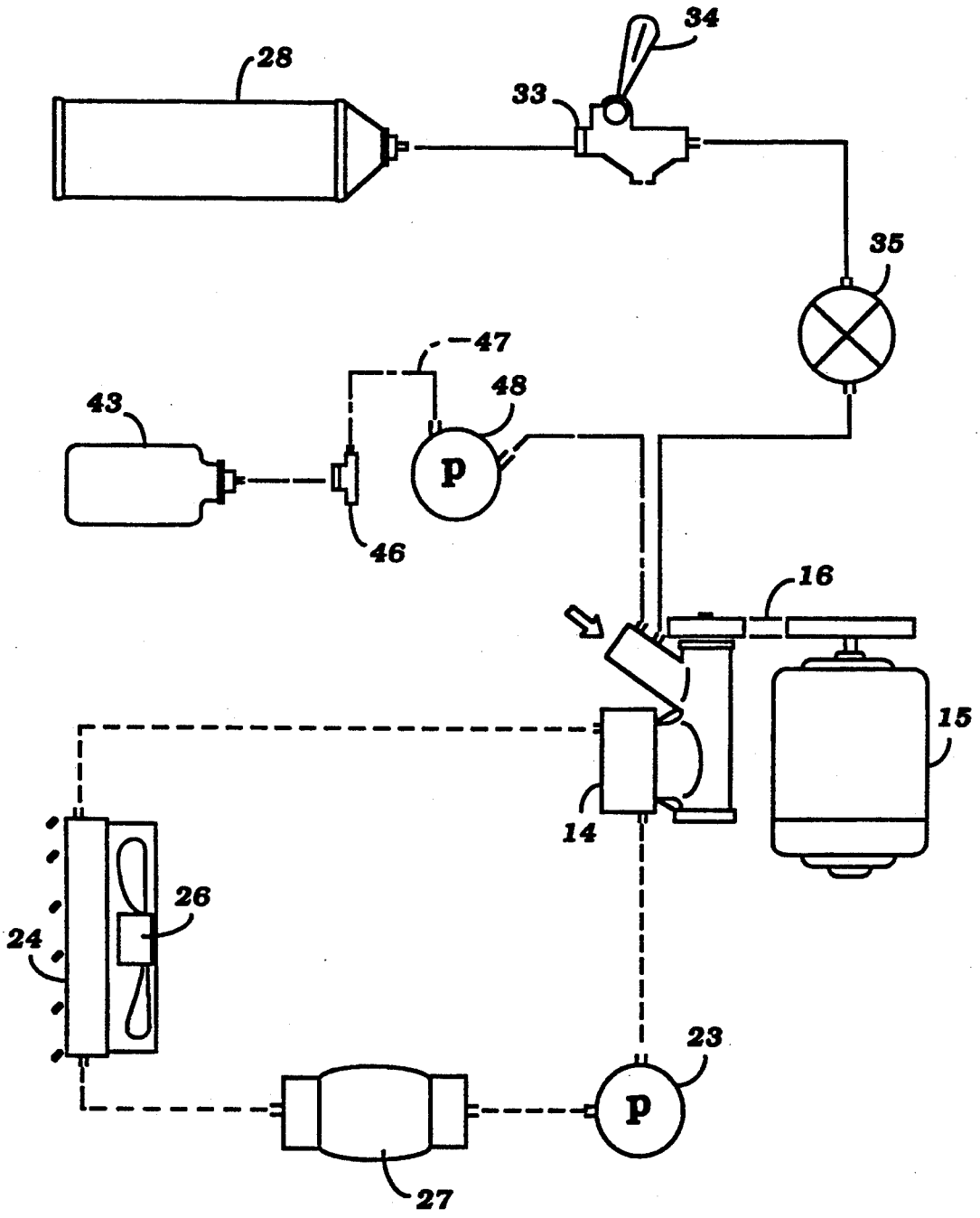
FIG. 2 is a partially schematic view showing the components of the power supply and their interrelationship.
Figure 3:
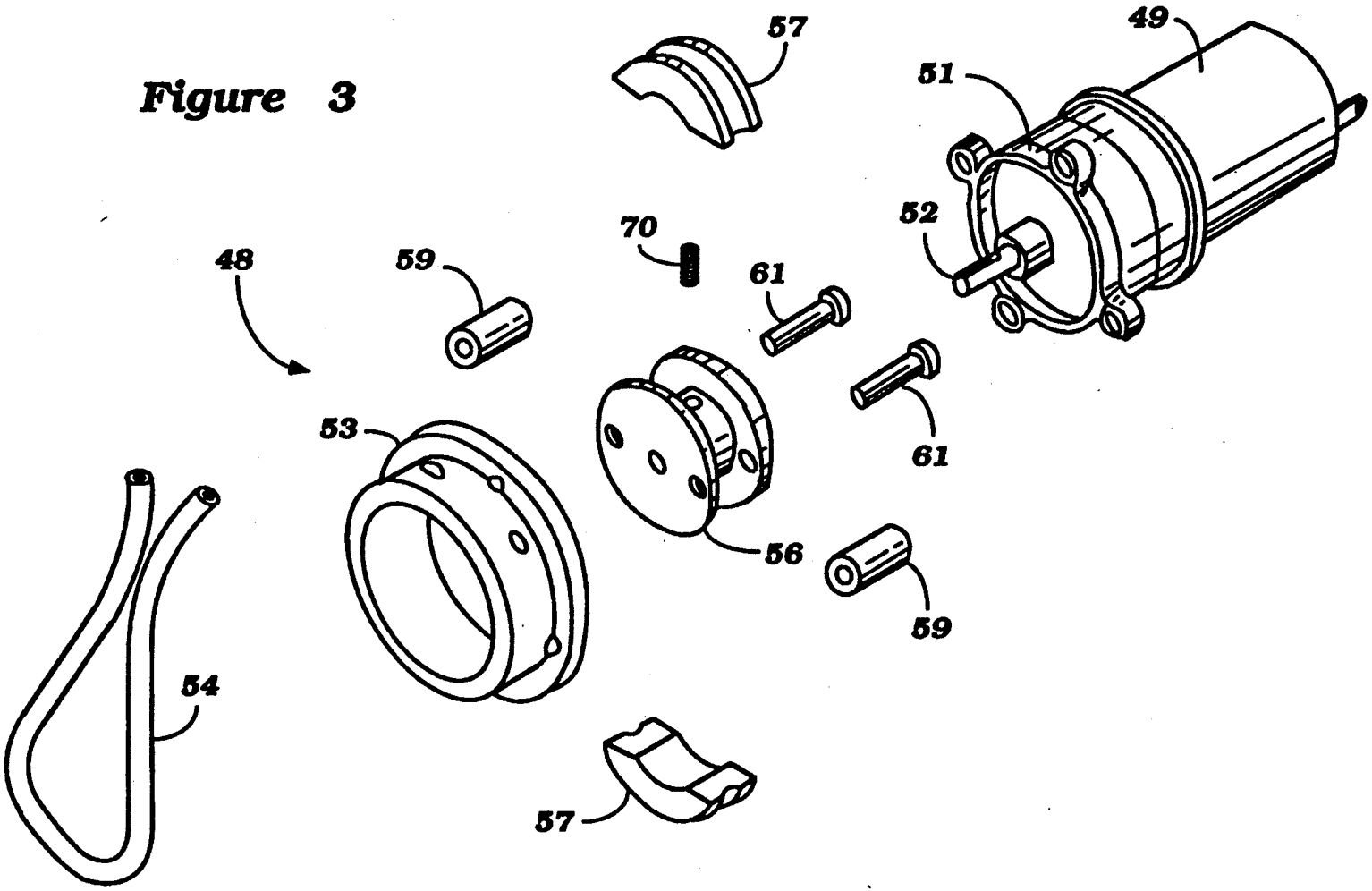
FIG. 3 is a partially exploded perspective view showing the lubricant pumping arrangement for the engine.
Figure 6:
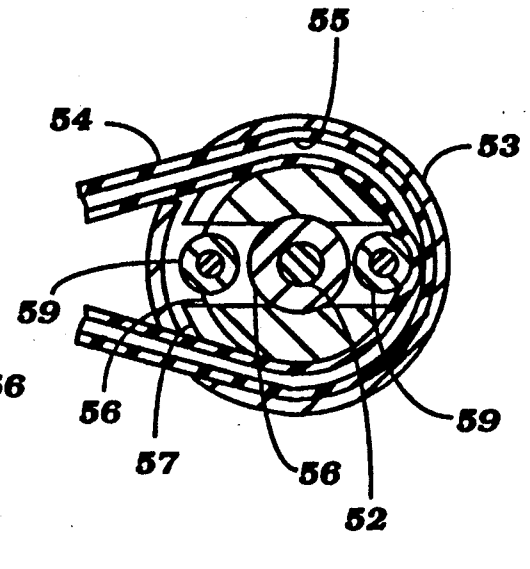
FIG. 6 is a cross-sectional view taken along the line 6—6 of FIG. 5.
Figure 5:
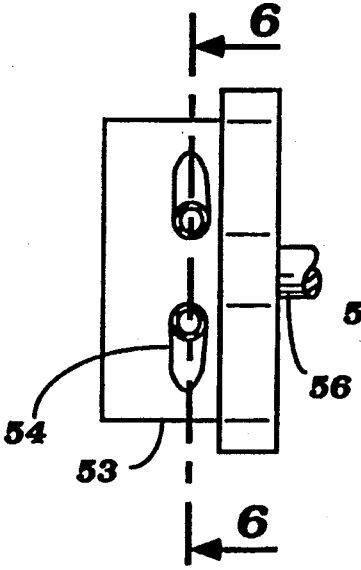
FIG. 5 is a side elevational view of the lubricant pump.
Figure 4:
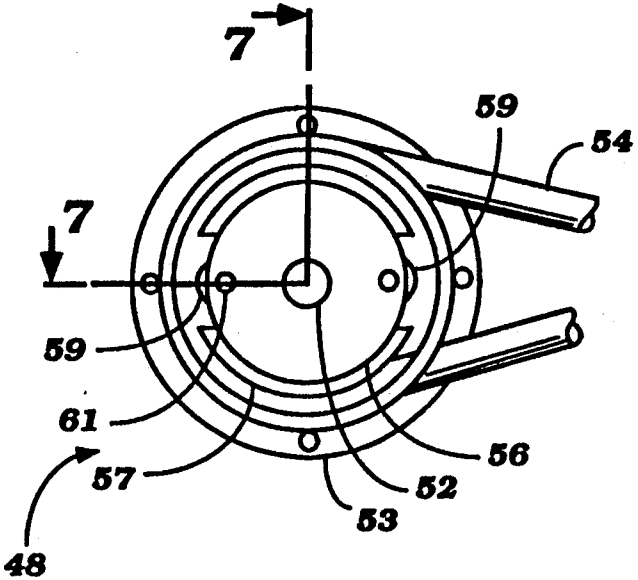
FIG. 4 is a front elevational view of the lubricant pump.
Figure 7:
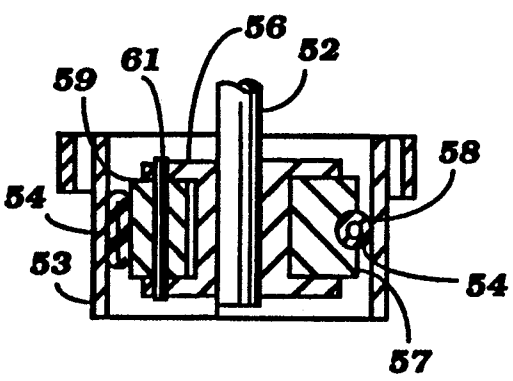
FIG. 7 is a cross-sectional view taken along the line 7—7 of FIG. 4.

Referring first primarily to FIGS. 1 and 2, a compact portable electric power supply constructed in accordance with an embodiment of the invention is identified generally by the reference numeral 11. The power unit 11 is comprised of an outer housing, indicated generally by the reference numeral 12, and which contains all of the components of the power supply. The outer housing 12 may be formed from any suitable material such as a molded plastic and is formed with a carrying handle 13 formed by an opening at its upper end.

Contained with the outer housing 12 is a single cylinder, liquid cooled, small displacement internal combustion engine, indicated generally by the reference numeral 14. In the illustrated embodiment, the engine 14 is operated under the two-stroke, crankcase compression principle, however, it should be readily apparent to those skilled in the art that the engine 14 may be a four-stroke cycle engine and may have other than a single cylinder and, in fact, may be a rotary or other type of engine than a reciprocating engine.

The engine 14 has its output shaft connected to a shaft of a combined starter and generator 15 by means of a driving belt 16. The starter, generator 15 is coupled with an electrical circuit that includes a vertically positioned battery 17 contained within a compartment 18 formed by the outer housing 12. This circuit permits the starter, generator 15 to operate as a starter so as to start the engine 14. Once the engine 14 commences running, the starter, generator 15 will operate as a generator and supply a charge to the battery 17 and also provide an electrical output to a receptacle 19 carried adjacent the handle 13 so as to permit an electrical device to be plugged in and powered by the unit 11.

There is provided adjacent the handle 13 on the side opposite the receptacle 19 a main control switch 21 for switching the power on and off and a starter switch 22 for operating the starter, generator 15 in its starter mode.

The engine 14 is further provided with a cooling system that includes a coolant pump 23 that is driven by the engine 14 and which circulates coolant through a cooling jacket of the engine and a heat exchanging radiator 24. The radiator 24 is juxtaposed to an air inlet opening 25 formed at on side of the housing 12. There is further provided an electric fan 26 that is powered by the battery 17 and which circulates the air across the core of the radiator 24. The cooling system also includes an accumulator type pressure control device 27 which is comprised generally of an expansible hose section so as to compensate for volume differences in the coolant of the engine 14 as occur during engine operation.

The engine 14 is fueled by a pressurized source of gaseous fuel (LPG) that is contained within a removable container 28 that is detachably connected to a receptacle 29 immediately beneath the handle portion 13. The container 28 is placed into the receptacle 29 through an opening 31 formed at one side of the housing 12 and which opening is normally closed by a closure plug 32.

The receptacle 29 is coupled to a main shutoff valve 33 having a control handle 34 so as to permit the supply of fuel from the container 28 to be shut off from the remainder of the fuel supply circuit for the engine when the power supply 11 is not being utilized.

A conduit connects the main shutoff valve 33 with a duty solenoid valve 35 which controls the flow of fuel to the induction system of the engine 14 in a manner as described in the copending patent application entitled "Gas Engine", Ser. No. 377,419, filed Jul. 10, 1989, and assigned to the assignee of this application now issued as U.S. Letters Pat. No. 5,012,781, on May 7, 1991. The disclosure of that application is incorporated herein by reference.

The engine 14 further includes an exhaust system that is comprised of a muffler 36 that is juxtaposed to an air outlet opening 37 which is formed at the side of the housing 12 opposite to the inlet opening 25. Air which has passed across the engine will then exit from the air outlet opening 37 so as to cool the muffler 36. The muffler 36 also has a discharge opening 38 which registers with the opening 37 for discharge of exhaust gases from within the housing 12.

The engine 14 and generator 15 are contained within a main cavity 39 formed by the outer housing 22 and are surrounded by a protective shield 41 for further heat insulation and ducting. An engine driven fan 42 circulates air from within the housing 12 across the engine 14, muffler 36 and out the opening 37.

The engine 14 is also provided with a lubricating system that receives lubricant from a separate lubricant container 43 that is received within a compartment 44 formed in the outer housing 12 and which is closed by a removable closure plug 45. The lubricant container 43 is of the cartridge type and is connected to a receiver 46 that supplies lubricant to the engine induction system through a conduit, shown schematically at 47 and in which a lubricant control pump 48 having a construction as best understood by reference to FIGS. 3 through 7 is positioned. The lubricant pump 48 is designed so as to provide a positive flow of lubricant and also will in effect close the conduit 47 when the engine is not running so that lubricant cannot inadvertently flow from the reservoir 43 to the engine 14. The pump 48 also meters a very small amount of lubricant, in a manner as will be described, so as to insure very good lubrication for the engine under all running conditions and to avoid excess lubricant flow and consumption.

Referring now in detail to FIGS. 3 through 7, the lubricant pump 48 includes an electric motor 49 that is powered from the battery 17 and which drives a gear reducer 51 which, in turn, drives an output shaft 52 at a substantially reduced speed. The speed of rotation of the output shaft 52 such as in the range of 1 to 50 rpm so as to pump a very small quantity of lubricant as is required by the engine during its running.

A cylindrical housing 53 encircles the output shaft 52 and contains a length 54 of flexible hose which forms a portion of the conduit 47. The hose 54 is looped around and engaged with a cylindrical interior wall 55 of the housing 53. An inner housing 56 is affixed for rotation with the output shaft 52 and carries a pair of segmented arcuate tube guides 57 that have reliefs 58 that are complementary in shape to the exterior of the hose 54.

Between these tube guides 57, there are provided a pair of rollers 59 that are supported on pin shafts 61 coupled to the inner housing 56 at diametrically opposite sides. The rollers 59 have a diameter that is sufficient so as to compress the hose 54 when the rollers 59 engage it. As a result, liquid will be trapped in the section of the hose between the lubricant supply 43 and the lubricating system of the engine 14. As the shaft 52 rotates, this trapped lubricant will be delivered to the engine lubricating system. It should be noted that the construction is such that one of the rollers 59 is always engaged with the hose 54. As a result, even when the engine is not running, the hose 54 will be compressed and lubricant cannot seep out of the hose from the reservoir 43. As a result, excess lubricant consumption will be avoided.

It should be readily apparent from the foregoing description that an extremely compact assembly is provided for generating electrical power which is powered by an engine embodying an improved lubricant pump that will deliver small amounts of lubricant regardless of the orientation of the unit and also designed so as to avoid lubricant leakage. The foregoing description is of a preferred embodiment of the invention and various changes and modifications may be made without departing from the spirit and scope of the invention as defined by the appended claims.

We claim:

1. A compact portable power supply comprising an outer housing having a carrying handle, an internal combustion engine supported within said outer housing, a cooling system for said engine comprising a cooling jacket for said engine, a radiator and means for circulating coolant between said cooling jacket and said radiator all within said outer housing, air inlet means in said outer housing for admitting air thereto, air outlet means in said outer housing for discharging air therefrom, said radiator being positioned in proximity to one of said air means, a combined generator, starter coupled to said engine for starting of said engine and for generating electrical power when said engine is running, said starter, generator being contained within said outer housing, a battery within said outer housing for operating said starter, generator when starting and for being charged by said starter, generator when said engine is running, a source of pressurized gaseous fuel for said engine within said outer housing and a lubricating system for said engine including a removable lubricant source accessible through an opening in said outer housing and closed by a removable closure.

2. A compact portable power supply as set forth in claim 1 further including a receptacle for detachably receiving a container of pressurized gaseous fuel through an opening formed in the outer housing and closed by a removable closure.

3. A compact portable power supply as set forth in claim 1 wherein the engine is provided with an exhaust system including a muffler disposed in proximity to one of the housing air means.

4. A compact portable power supply as set forth in claim 3 wherein the radiator is positioned in proximity to the air inlet means and the muffler is positioned in proximity to the air outlet means.

5. A compact portable power supply as set forth in claim 4 wherein the muffler has a discharge opening positioned in proximity to the air outlet means.

6. A compact portable power supply as set forth in claim 1 further including a lubricant pump for delivering lubricant to the engine lubricating system from the reservoir including conduit means extending therebetween, said conduit means including a flexible hose portion, and pumping means for sequentially compressing a part of said flexible hose portion close to said lubricant supply and means for moving said pumping means and the compressed area of said hose portion toward said engine lubricant system for delivering lubricant thereto.

7. A compact portable power supply as set forth in claim 6 wherein there are a pair of pumping means for sequentially compressing the hose.

8. A compact portable power supply as set forth in claim 7 wherein the pumping means are disposed so that the hose is always compressed by at least one of the pumping means.

9. A compact portable power supply as set forth in claim 8 wherein the flexible hose has a loop in it and the pumping means comprise rollers carried by a rotating member positioned internally of the loop of the hose.

10. A compact portable power supply as set forth in claim 6 wherein the lubricant is supplied from a readily removable and replaceable source comprising a container and contained lubricant.

11. A compact portable power supply as set forth in claim 6 wherein the lubricant is mixed with air upon delivery to the engine.

12. A compact portable power supply as set forth in claim 11 wherein the lubricant is supplied to the engine induction system.

13. A compact portable power supply as set forth in claim 12 wherein the engine is a two-cycle, crankcase compression internal combustion engine.

14. A compact portable power supply as set forth in claim 13 wherein there are a pair of pumping means for sequentially compressing the hose.

15. A compact portable power supply as set forth in claim 14 wherein the pumping means are disposed so that the hose is always compressed by at least one of the pumping means.

16. A compact portable power supply as set forth in claim 15 wherein the flexible hose has a loop in it and the pumping means comprise rollers carried by a rotating member positioned internally of the loop of the hose.

* * * * *